US005439771A

United States Patent [19]

Baba et al.

[11] Patent Number: 5,439,771

[45] Date of Patent: Aug. 8, 1995

[54] CARRIER FOR USE IN ELECTROPHOTOGRAPHY, TWO COMPONENT-TYPE DEVELOPER AND IMAGE FORMING METHOD

[75] Inventors: Yoshinobu Baba, Yokohama; Yasuko Amano, Ebina; Hitoshi Itabashi, Yokohama, all of Japan

[73] Assignee: Canon Kabushiki Kaisha, Tokyo, Japan

[21] Appl. No.: 103,034

[22] Filed: Jul. 28, 1993

[30] Foreign Application Priority Data

Jul. 28, 1992 [JP] Japan ..... 4-201403
Oct. 15, 1992 [JP] Japan ..... 4-277235

[51] Int. Cl.[6] ..... G03G 9/107

[52] U.S. Cl. ..... 430/106.6; 430/108; 430/111

[58] Field of Search ..... 430/106.6, 108, 111

[56] References Cited

U.S. PATENT DOCUMENTS 2,297,691 10/1942 Carlson ..... 430/31
3,666,363 5/1972 Tanaka et al. ..... 430/55
4,071,361 1/1978 Marushima ..... 430/55
4,600,675 7/1986 Iwasa et al. ..... 430/106.6
4,898,801 2/1990 Tachibana et al. ..... 430/108 X
5,268,249 12/1993 Saha et al. ..... 430/108 X

FOREIGN PATENT DOCUMENTS 0142731 5/1985 European Pat. Off. .
0384697 8/1990 European Pat. Off. .
59-104663 6/1984 Japan .
4-3868 1/1992 Japan .

*Primary Examiner*—Roland Martin
*Attorney, Agent, or Firm*—Fitzpatrick, Cella, Harper & Scinto

[57] ABSTRACT

A two component-type developer for electrophotography showing improved electrophotographic performances and also free from carrier adhesion (undesirable carrier transfer to the photosensitive member and recording materials) is constituted by using a magnetic carrier comprising a soft magnetic material of 5–100 μm in particle size. The carrier has a bulk density of at most 3.0 g/cm$^3$, and magnetic properties including: a magnetization of 30–150 emu/cm$^3$ under a magnetic field strength of 1000 oersted, and relationships (1) and (2):

$$|\sigma_{1000}-\sigma_{300}|/\sigma_{1000}\leqq 0.40 \quad (1)$$

wherein $\sigma_{1000}$ and $\sigma_{300}$ denote magnetizations (emu/cm$^3$) under magnetic field strengths of 1000 oersted (Oe) and 300 oersted (Oe), respectively, and $$0.15\ (\text{emu/cm}^3.\text{Oe})\leqq|\sigma_{100}-\sigma_r|/100\ (\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

39 Claims, 6 Drawing Sheets

CARRIER FOR USE IN ELECTROPHOTOGRAPHY, TWO COMPONENT-TYPE DEVELOPER AND IMAGE FORMING METHOD

FIELD OF THE INVENTION AND RELATED ART

The present invention relates to a carrier for use in electrophotography to be mixed with a toner to constitute a developer for developing an electrostatic latent image, a two component-type developer containing the carrier, and an image forming method using the developer.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, then, in case of normal development, colored fine particles, called a toner, having a polarity of charge opposite to that of the latent image is attached onto the latent image to develop the latent image Subsequently, the resultant toner image is, after being transferred onto a transfer material such as paper or a synthetic resin film, as desired, fixed, e.g., by heating, pressing, or heating and pressing, or with solvent vapor to obtain a copy.

In the step of developing the latent image, toner particles charged to a polarity opposite to that of the latent image are attracted by electrostatic force and attach onto the latent image (alternatively, in case of reversal development, toner particles having a triboelectric charge of the same polarity as that of the latent image are used). In general, methods for developing an electrostatic latent image with a toner can be classified into a developing method using a two component-type developer constituted by mixing a small amount of a toner with carrier and a developing! method using a monocomponent-type developer constituted by a toner alone without containing a carrier.

The electrophotographic processes have reached a satisfactory level for use in document copying but are still desired be improved, e.g., so as to provide a further high image quality. For example, electrophotographic processes for providing a full-color image are still desired to be improved in image quality or quality level by various means including digital image processing and alternating electric field application at the time of development in view of progresses in computer technology, high definition television technology, etc.

Heretofore, the two component-type developer has been used for providing a full-color image. Generally, the carrier constituting the two component-type developer may be classified into a conductive carrier represented by iron powder and an insulating carrier formed by coating the surface of particles of, e.g., iron powder, nickel powder or ferrite powder with an insulating resin. When an alternating electric field is applied in order to obtain a high image quality, charges are leaked through a carrier to decrease a latent image potential if the carrier has a low resistivity, thus failing to provide a good developed image. Accordingly, a carrier is required to have at least a certain level of resistivity. In case where a carrier core is conductive, the carrier core is preferably coated. A ferrite having a high resistivity to a certain extent has been preferred as a core material.

In general, since the iron powder has strong magnetism, a magnetic brush formed by a developer containing the iron powder carrier is hardened in a region for developing a latent image with a toner contained in the developer, thus causing a brush image or a coarse image. As a result, it is difficult to obtain a high quality-developed image. Therefore, a ferrite has been preferably used also in order to provide a high quality image by lowering a magnetic force of a carrier used.

In order to form a high quality image, it has been proposed to use a carrier having saturation magnetization of at most 50 emu/cm$^3$ so as to provide good developed images free from brush images in Japanese Laid-Open Patent Application (JP-A) 59-104663. In this instance, as the value of saturation magnetization of the carrier is gradually lowered, a better thin-line reproducibility is obtained but on the other hand, there is noticeably observed a phenomenon that the carrier is transferred and adheres to an electrostatic latent image bearing member such as a photosensitive drum as the carrier transfers from a magnetic pole (hereinafter, referred to as "carrier adhesion").

Japanese Patent Publication (JP-B) 4-3868 has disclosed a hard ferrite carrier having a coercive force of at least 300 G(gauss). However, when such a hard ferrite carrier is used, a developing device including the hard ferrite carrier is unavoidably enlarged in size. In order to realize a small-sized high quality color copying machine, it is preferable that a developer-carrying member using a fixed magnetic core is used. In this case, the above-mentioned hard ferrite carrier having a high coercive force has caused a problem of poor carrying (or conveying) characteristic due to its self-agglomeration property.

As described above, it is desired to provide a carrier for use in electrophotography capable of providing a high quality image, particularly an image with a good reproducibility at a highlight part, while suppressing carrier adhesion.

SUMMARY OF THE INVENTION

A general object of the present invention is to provide a carrier for! use in electrophotography, a two component-type developer and an image forming method having solved the above-mentioned problems.

A more specific object of the present invention is to provide a carrier for use in electrophotography a two component-type developer and an image forming method capable of effecting a development faithful to an original, i.e., a latent image.

Another object of the present invention is to provide a carrier for use in electrophotography, a two component-type developer and an image forming method excellent in resolution, reproducibility at a highlight part, and thin-line reproducibility.

Another object of the present invention is to provide a carrier for use in electrophotography, a two component-type developer and an image forming method capable of providing a high quality developed image without causing carrier adhesion even in a high-speed development.

Another object of the present invention is to provide a carrier for use in electrophotography, a two component-type developer and an image forming method capable of providing a high quality developed image without causing carrier adhesion even in development under an alternating electric field.

A further object of the present invention is to provide a carrier for use in electrophotography, a two component-type developer and an image forming method capable of being applicable to a small-sized developing device using a fixed magnetic core-type developer-carrying member for obtaining a high quality image.

A still further object of the present invention is to provide a carrier for use in electrophotography, a two component-type developer and in image forming method Capable of retaining a high quality image free from a deterioration in image quality even in copying test on a large number of sheets.

According to the present invention, there is provided a carrier for use in electrophotography, comprising carrier particles having an average particle size of 5–100 μm, wherein the carrier comprises a soft magnetic material having a bulk density of at most 3.0 g/cm$^3$, and magnetic properties including: a magnetization of 30–150 emu/cm$^3$ under a magnetic field strength of 1000 oersted, and relationships (1) and (2):

$$|\sigma_{1000}-\sigma_{300}|\sigma_{1000}\leqq 0.40 \quad (1)$$

wherein $\sigma_{1000}$ and $\sigma_{300}$ denote magnetizations (emu/cm$^3$) under magnetic field strengths of 1000 oersted (Oe) and 300 oersted (Oe), respectively, and $$0.15\ (\text{emu/cm}^3.\text{Oe})\leqq|\sigma_{100}-\sigma_r|/100\ (\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

According to the present invention, there is further provided a two component-type developer for developing an electrostatic image, comprising a toner and a carrier, the carrier comprising carrier particles having an average particle size of 5–100 μm, wherein the carrier comprises a soft magnetic material having a bulk density of at most 3.0 g/cm$^3$, and magnetic properties including: a magnetization of 30–150 emu/cm$^3$ under a magnetic field strength of 1000 oersted, and relationships (1) and (2):

$$|\sigma_{1000}-\sigma_{300}|/\sigma_{1000}\leqq 0.40 \quad (1)$$

wherein $\sigma_{1000}$ and $\sigma_{300}$ denote magnetizations (emu/cm$^3$) under magnetic field strengths of 1000 oersted (Oe) and 300 oersted (Oe), respectively, and $$0.15\ (\text{emu/cm}^3.\text{Oe})\leqq|\sigma_{100}-\sigma_r|/100\ (\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

According to the present invention, there is further provided an image forming method, comprising:

conveying a two component-type developer comprising a toner and a magnetic carrier carried on a developer-carrying member to a developing station, and forming a magnetic brush of the developer in a magnetic field formed by a developing magnetic pole disposed inside the developer carrying member at the developing station and causing the magnetic brush to contact an electrostatic latent image held on a latent image-bearing member, thereby developing the electrostatic latent image to form a toner image;

wherein the carrier comprises carrier particles having an average particle size of 5–100 μm, wherein the carrier comprises a soft magnetic material having a bulk density of at most 3.0 g/cm$^3$, and magnetic properties including: a magnetization of 30–150 emu/cm$^3$ under a magnetic field strength of 1000 oersted, and relationships (1) and (2):

$$|\sigma_{1000}-\sigma_{300}|/\sigma_{1000}\leqq 0.40 \quad (1)$$

wherein $\sigma_{1000}$ and $\sigma_{300}$ denote magnetizations (emu/cm$^3$) under magnetic field strengths of 1000 oersted (Oe) and 300 oersted (Oe), respectively, and $$0.15\ (\text{emu/cm}^3.\text{Oe})\leqq|\sigma_{100}-\sigma_r|/100\ (\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
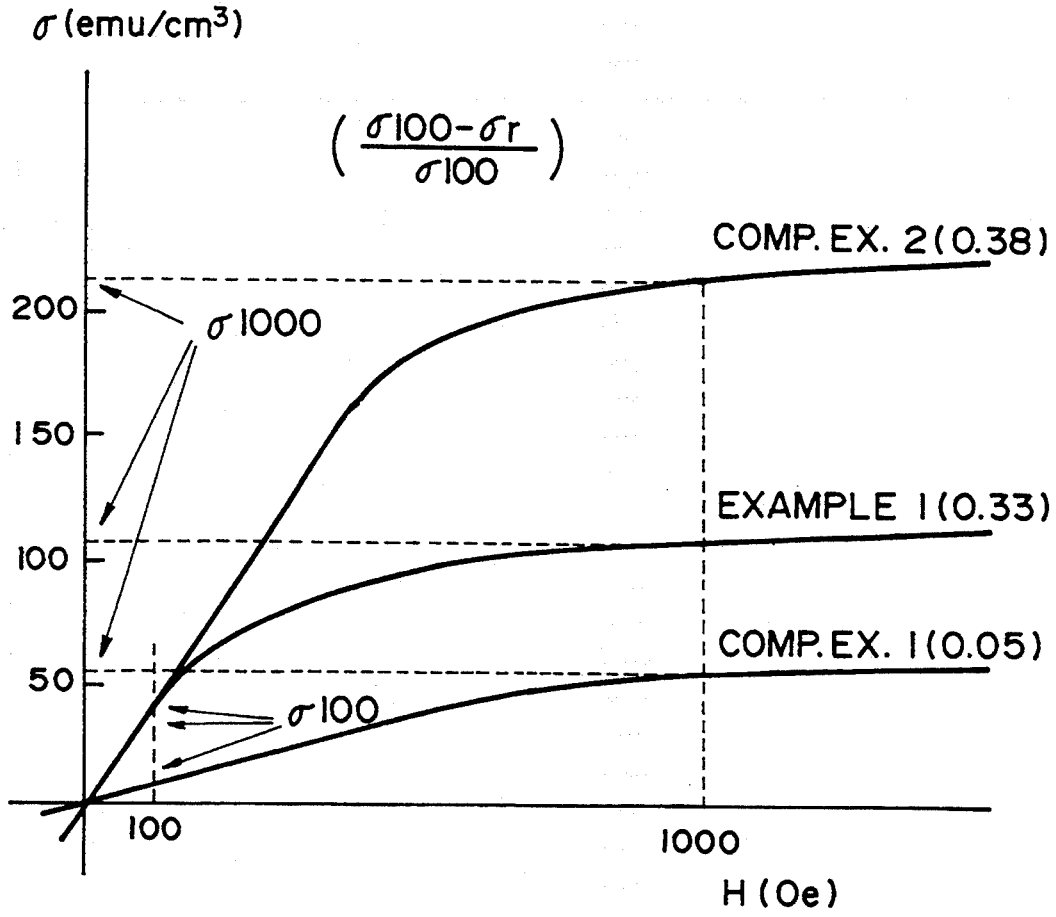
FIG. 1 is a graph showing magnetic characteristic curves (magnetization curves) of carriers plotted with an external magnetic field (oersted) on the abscissa and with a magnetization per unit volume of the carriers on the ordinate and also along with values of $(\sigma_{100}-\sigma_r)/\sigma_{100}$ as parameters.

The reasons why the carrier according to the present invention can solve the above-mentioned problems of the conventional carriers and can effect development faithful to an original (i.e., a latent image) while suppressing carrier adhesion, may be considered as follows.

In order to effect development faithful to a latent image, it is important to provide a magnetization (intensity) of 30–150 emu/cm$^3$ to the carrier at a developing magnetic pole under application of a magnetic field. In general, the strength of the magnetic field at the developing magnetic pole is about 1000 oersted (Oe). In this instance, if the carrier is caused to have a relatively small magnetization (i.e., 30–150 emu/cm$^3$), a magnetic brush of a developer containing the carrier becomes shorter, denser and softer to allow the above-mentioned development faithful to the latent image. Particularly, in case where an alternating electric field vibrating the developer is applied to a developing station to effect development, the developing efficiency is improved to achieve a very faithful development since the magnetic brush becomes shorter, denser and softer as described above. The reason why the carrier of the present invention can prevent deterioration of image quality and allow maintenance of high-quality images as obtained at the initial stage for a long period, may be attributable to the characteristics that a two component-type developer containing such a carrier having a weak magnetization, when applied onto a developing sleeve enclosing a fixed magnet, provides soft carrier brushes exerting a weak magnetic field to each other in the neighborhood of the regulating member and thus not exerting a substantial shear to the toner.

As a result of further study, it has been found that the carrier adhesion is liable to occur in a magnetic field of 0–300 oersted and, if the carrier magnetization at that time is sufficiently high up to a certain level, the carrier adhesion is not caused or not readily caused. The carrier adhesion is also affected by the developing bias condition and is more readily caused in the case of development under application of an alternating magnetic field than a DC electric field when the carrier has a charge so that a magnetic force is required in order to retain the carrier on the developing sleeve. Accordingly, the above-mentioned level of magnetization under electric field is required for suppressing the carrier adhesion. In the present invention, as shown by a magnetization curve shown in FIG. 1, a carrier showing an increased magnetization under 0–300 oersted resulting from a quickly increased magnetization under 0–100 oersted while showing a lower magnetization at 1000 oersted $\sigma_{1000}$ of 30–150 emu/cm$^3$ compared with that of a conventional carrier is used to prevent the carrier adhesion while obtaining high quality images.

In a developing system using a developing sleeve having a fixed magnet disposed therein, the developer used is improved in fluidity, particularly in a high-speed development, by using a carrier comprising a soft magnetic material, thus being excellent in a conveying characteristic to provide a still higher quality image.

Then, a constitution of the carrier according to the present invention will be explained more specifically.

The carrier used in the present invention comprises carrier particles showing the following magnetic properties.

The carrier particles are required to show a magnetization ($\sigma_{1000}$) of 30–150 emu/cm$^3$ at 1000 oersted after magnetic saturation (by applying a magnetic field of, e.g., 2 k Oe). For further improved image quality, a range of 30–120 emu/cm$^3$ is prepared. Above 150 emu/cm$^3$, the resultant density of the developing is not very different from that of the conventional brush, so that it becomes difficult to obtain high-quality toner images. Below 30 emu/cm$^3$, the magnetic constraint force at 0–300 oersted is decreased so that the carrier adhesion is liable to be caused.

In the present invention, it is important that the carrier has an increased magnetization at zero to 100 oersted. Thus, the carrier is required to satisfy the following relationship (2):

$$0.15\ (\text{emu/cm}^3.\text{Oe}) \leqq |\sigma_{100}-\sigma_r|/100\ (\text{Oe}) \qquad (2)$$

wherein $\sigma_{100}$ and $\sigma_r$ denote magnetizations (emu/cm$^3$) under magnetic field strengths of 100 (Oe) and zero (Oe), respectively.

An explanation is given with reference to FIG. 1 which shows magnetization curves of carriers of Example 1 and Comparative Examples 1 and 2 appearing hereinafter. If the value of $|\sigma_{100}-\sigma_r|/100$ is below 0.15, it becomes difficult to prevent the carrier adhesion since the magnetization at zero to 100 (Oe) is lower (i.e., the relationship (2) is not satisfied) and thus the magnetization at 0–300 (Oe) becomes insufficient.

In order to provide high-quality images, it is also important in the present invention that the carrier particles satisfy a relationship represented by the following formula (1):

$$|\sigma_{1000}-\sigma_{300}|/\sigma_{1000} \leqq 0.40 \qquad (1)$$

wherein $\sigma_{1000}$ and $\sigma_{300}$ denote magnetizations (emu/cm$^3$) under magnetic field strengths of 1000 Oersted and 300 oersted, respectively. The ratio, which may be referred to as a magnetization stability (factor) herein, may preferably be at most 0.30.

Figure 2:
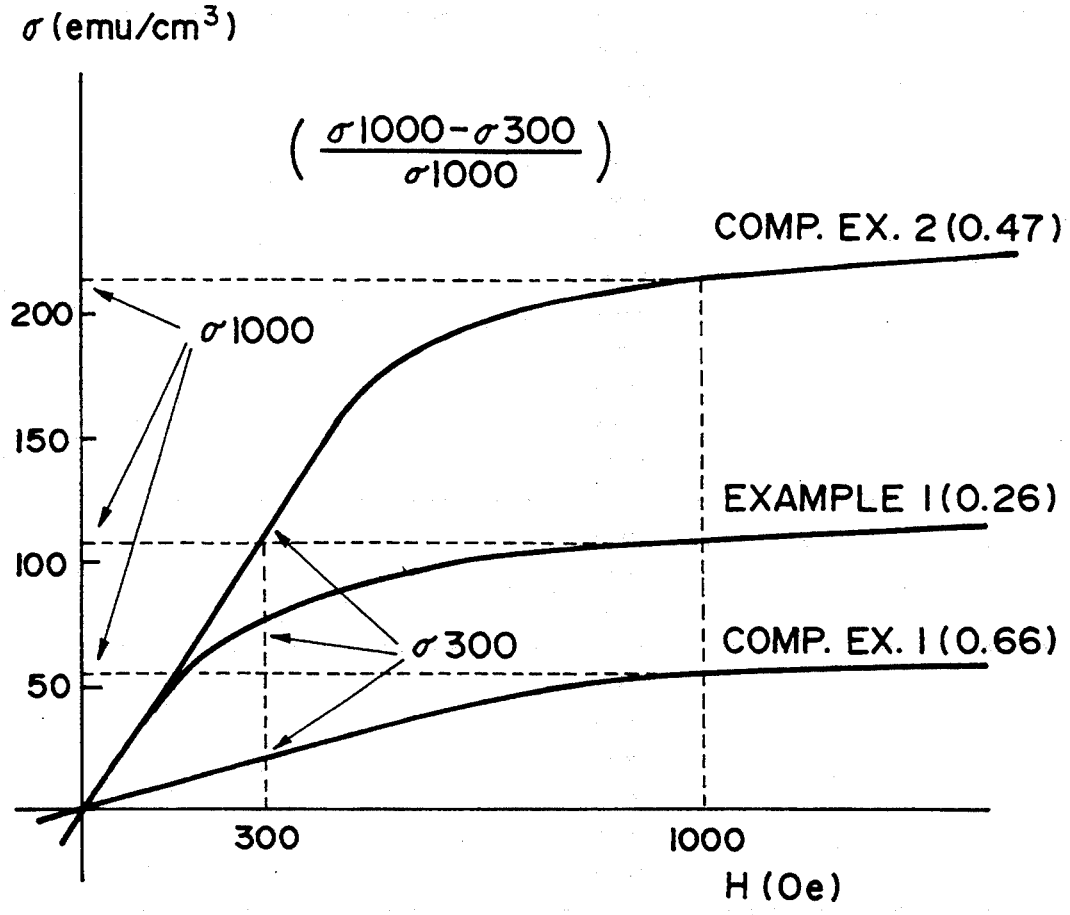
FIG. 2 is a graph showing magnetic characteristic curves (magnetization curves) of carriers plotted with an external magnetic field (oersted) on the abscissa and with a magnetization per unit volume of the carriers on the ordinate and also along with values of $(\sigma_{1000}-\sigma_{300})/\sigma_{1000}$ as parameters.

An explanation is given with reference to FIG. 2 which shows magnetization curves after magnetic saturation of carriers of Example 1 and Comparative Examples 1 and 2 appearing hereinafter. If the value (magnetization stability) exceeds 0.40, it becomes difficult to prevent the carrier adhesion while improving the image quality. More specifically, if $\sigma_{1000}$ is set to a satisfactory value for improving the image quality, the carrier adhesion is liable to occur. If $\sigma_{300}$ is set to a satisfactory value, the carrier adhesion can be prevented but $\sigma_{1000}$ becomes too large to obtain high-quality images.

Thus, it is possible to exhibit the effects of the present invention by satisfying the relationships (1) and (2).

In the present invention, the magnetic values may be measured, e.g., by using a DC magnetization B-H characterization auto-recording apparatus (e.g., "BHH-50" available from Riken Denshi K.K.). The magnetic values of carriers described herein have been obtained from hysteresis curves (magnetization curves obtained by producing magnetic fields of ±2 kilo-oersted. More specifically, the magnetic properties of a carrier may be measured by strongly packing a sample carrier in a cylindrical plastic container to form a fixed sample for measurement of the magnetic properties. The magnetic moment per unit volume measured in this state are described herein as representative values. A sample holder used had a volume of 0.332 cm$^3$ which may be used for calculation of a magnetization (magnetic moment) per unit volume.

The carrier particles according to the present invention may preferably have an average particle size of 5–100 μm, more preferably 20–80 μm, further preferably 20–60 μm. Below 5 μm, the carrier adhesion onto a photosensitive member is liable to occur. Above 100 μm, the magnetic brush at a developing pole becomes coarse so that it becomes difficult to obtain high-quality toner images. The particle sizes of carriers described herein are based on values measured by sampling 300 particles at random through an optical microscope and measuring the average horizontal FERE diameter as a carrier particle size by an image analyzer (e.g., "Luzex 3" available from Nireco K.K.).

The carrier according to the present invention may preferably have a bulk density of at most 3.0 g/cm$^3$ as measured by JIS Z 2504. Above 3.0 g/cm$^3$, the force of magnetically retaining the carrier on the developing sleeve can be exceeded by a centrifugal force exerted to the carrier particles due to rotation of the developing sleeve, so that carrier scattering is liable to be caused.

The carrier according to the present invention may preferably have a sphericity of at most 2. If the sphericity exceeds 2, the resultant developer is caused to have a poor fluidity and provides a magnetic brush of an inferior shape, so that it becomes difficult to obtain high-quality toner images. The sphericity of a carrier may be measured, e.g., by sampling 300 carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

$$\text{Sphericity(SF1)}=[(\text{MX LNG})^2/\text{AREA}]\times\sigma/4$$

wherein MX LNG denotes the maximum diameter of a carrier particle, and AREA denotes the projection area of the carrier particle. As the sphericity is closer to 1, the shape is closer to a sphere.

Figure 3:
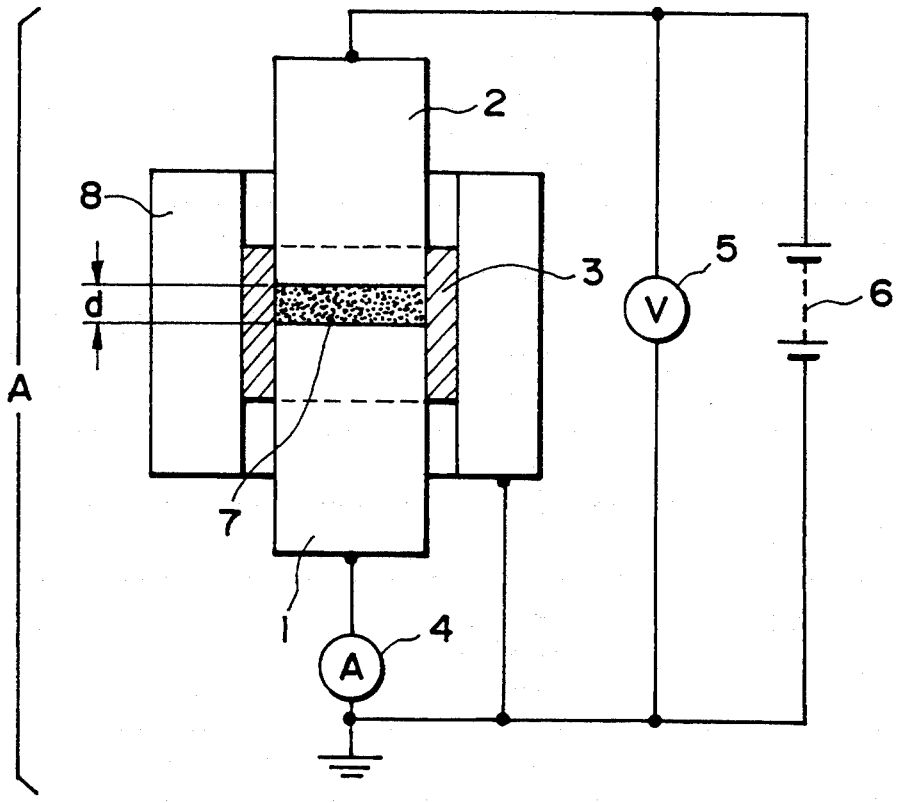
FIG. 3 is a schematic view showing a measurement apparatus of electrical resistivity.

The carrier according to the present invention may preferably have a resistivity of $10^8$–$10^{13}$ Ω.cm, when used in a developing method applying a bias voltage, the carrier is liable to cause a leak of current from the developing sleeve to the photosensitive member surface, thus causing difficulties in providing good toner images. Above $10^{13}$ Ω.cm, the carrier is liable to cause a charge-up phenomenon under low humidity conditions, thus causing toner image defects, such as a low image density, transfer failure, fog, etc. The resistivity may be measured by using an apparatus (cell) A as shown in FIG. 3 equipped with a lower electrode 1, an upper electrode 2, an insulator 3, an ammeter 4, a voltmeter 5, a constant-voltage regulator 6 and a guide ring 8. For measurement, the cell A is charged with a sample carrier 7, in contact with which the electrodes 1 and 2 are disposed to apply a voltage therebetween, whereby a current flowing at that time is measured to calculate a resistivity. In the above measurement, attention should be paid so as not to cause a change in packing density of a powdery carrier sample leading to a fluctuation in measured resistivity. The resistivity values described herein are based on measurement under the conditions of the contact area between the carrier 7 and the electrode 1 or 2=about 2.3 $cm^2$, the carrier thickness=about 1 mm, the weight of the upper electrode 2=275 g, and the applied voltage=100 volts.

In order to accomplish the above-mentioned properties of the carrier according to the present invention, it is preferred to use a soft magnetic material comprising: an iron-based alloy, such as alloys of iron-silicon (Fe-Si) type, iron-aluminum (Fe-Al) type, iron-silicon-aluminum (Fe-Si-Al) type, permalloy, etc.; and a ferrite, such as a soft ferrite, of manganese-zinc (Mn-Zn) type, nickel-zinc (Ni-Zn) type, manganese-magnesium (Mn-Mg) type, lithium (Li)-type. More preferably, the carrier may comprise magnetic ferrite particles containing at least one element selected from the group consisting of elements of groups IA, IIA, IIIA, IVA, VA, VIA, IB, IIB, IVB, VB, VIB, VIIB and VIII according to the periodic table, and less than 1 wt. %, if any, of another element.

More specifically, the carrier particles may preferably comprise a ferrite containing: Fe and O as essential elements; at least one element selected from the group consisting of Li, Bed B, C, N, Na, Mg, Al, Si, P, S, K, Ca, Ti, V, Cr, Mn, Co, Ni, Cu, Zn, Ga, Ge, As, Se, Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb, and Bi, and less than 1 wt. %, if any, of, another element. If another element different from those specifically mentioned above is contained, it becomes difficult to obtain a carrier showing the above-described desired magnetic properties according to the present invention and the resistivity is liable to be lowered.

The carrier according to the present invention may preferably comprise a ferrite having a single phase of a spinel structure.

By taking such a crystal form, it may presumably be possible to provide an improved or quickly increased magnetization even at a low magnetization field, thus preventing the carrier adhesion.

The carrier according to the present invention may be prepared through processes, such as sintering and atomizing. The carrier having the required properties of the present invention may be produced by granulation with a magnetic material having a sharp particle size distribution or controlling sintering temperature, heating rate, heat-retention time, etc., as desired.

The thus-obtained carrier may be classified by, e.g., a wind-force classifier to prepare carrier particles having an average particle size of 5–100 μm.

The carrier particles according to the present invention may be coated with a resin, as desired, for the purpose of resistivity control, improvement in durability, etc. The coating resin may be a known appropriate resin. Examples thereof may include styrene resin, acrylic resin, fluorine-containing resin, silicone resin and epoxy resin. Thus, the term "carrier" used herein covers both a coated carrier surface-coated with, e.g., a resin, and an uncoated carrier.

According to a preferred embodiment, the carrier of the present invention may be embodied as an electrophotographic carrier which comprises carrier particles comprising soft magnetic fine particles; the magnetic fine particles having a longer axis/shorter axis ratio exceeding 1, showing a shape anisotropy in three-dimensions at least a uniaxial direction and including at least 30 wt. % thereof in an oriented state; the carrier particles having magnetic properties including: a magnetization of 30–150 emu/$cm^3$ under a magnetic field strength of 1000 oersted, and relationships (1) and (2):

$$|\sigma_{1000}-\sigma_{300}|/\sigma_{1000}\leqq 0.40 \quad (1)$$

wherein $\sigma_{1000}$ and $\sigma_{300}$ denote magnetizations (emu/$cm^3$) under magnetic field strengths of 1000 oersted (Oe) and 300 oersted (Oe), respectively, and $$0.15\ (\text{emu/cm}^3.\text{Oe})\leqq|\sigma_{100}-\sigma_r|/100\ (\text{Oe}) \quad (2)$$

wherein $\sigma_{100}$ and $\sigma_r$ denote magnetizations (emu/$cm^3$) under magnetic field strengths of 100 (Oe) and zero (Oe), respectively.

In the present invention, it is possible to provide a further high durable developing characteristic by using a magnetic material-dispersion type resinous carrier wherein magnetic fine particles are dispersed within a binder resin since a torque of the developing sleeve used is further decreased.

The carrier of the present invention satisfies the above-mentioned relationships (1) and (2) simultaneously by having a degree of orientation of at least 30% with respect to the magnetic fine particles within the carrier, thus achieving the effects of the present invention.

Figure 6:
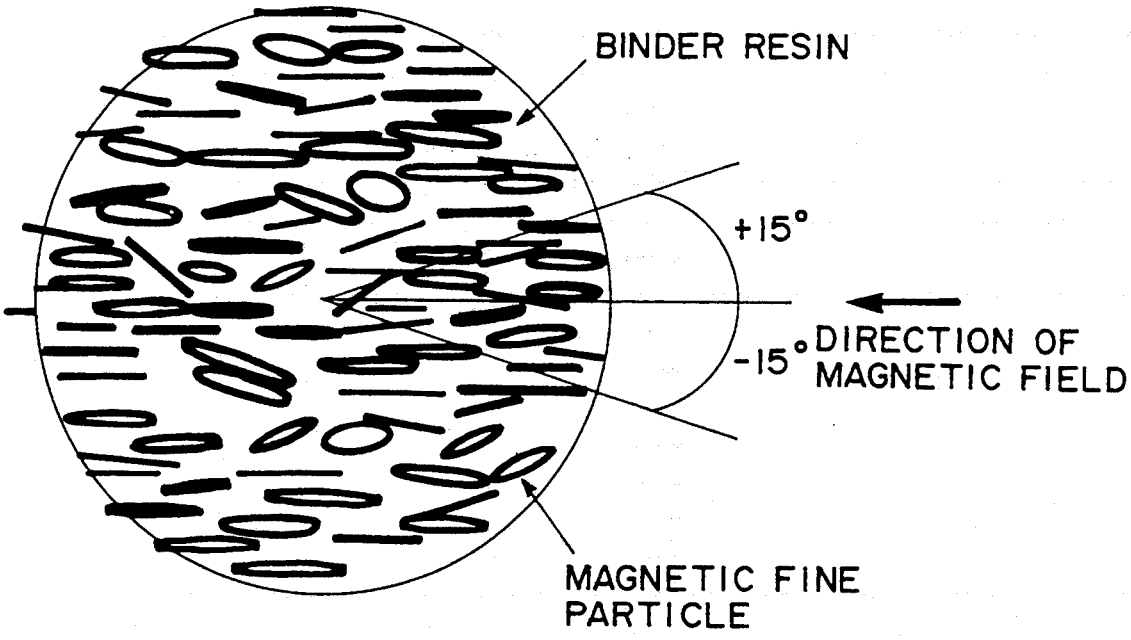
FIG. 6 is a schematic view of an orientation state of the carrier according to the present invention, wherein a magnetic material is dispersed within a binder resin and is also denoted by flat-shaped particles having a longer axis oriented parallel to the direction of an applied magnetic field (shown by an arrow).

Herein, the degree of orientation of the magnetic fine particles within the carrier may be defined by the proportion of oriented magnetic fine particles having a shape anisotropy used in the present invention and measured by statistically treating the orientation of magnetic fine particles at the carrier surface (or within a carrier section in case of the magnetic material-dispersion type resinous carrier) observed through a field-emission scanning electron microscope (FE-SEM) (e.g., "S-800", available fro Hitachi K.K.). More specifically, e.g., in case of the magnetic material-dispersion type resinous carrier, microscopic pictures showing 10 carrier sections sampled at random are taken, and 100 magnetic fine particles showing a shape anisotropy are taken at random from the pictures to calculate the proportion of the magnetic fine particles oriented within a range of ±15 degrees from an assumed direction of the magnetic field. Carrier section samples may be prepared by dispersing carrier particles within an epoxy resin, followed by fixation by solidification, and slicing the carrier-embedded resin samples by a microtome (e.g., "FC4E", available from REICHER-JUNG). For example, in case where a flat-shaped magnetic material is used, as shown in FIG. 6, the magnetic fine particles have a longer axis oriented parallel to the direction of an applied magnetic field (shown by an arrow). The proportion of the magnetic fine particles oriented with the above-mentioned range is counted to determine the orientation degree.

In order to accomplish the above-mentioned magnetic properties of the carrier according to the present invention, the carrier may be constituted by a soft magnetic material comprising an amorphous alloy having a shape anisotropy and a maximum diameter (i.e., a length of longer axis) of at most 2 μm. Examples of such an amorphous alloy may include alloys of Fe-Si type, Fe-Si-B type, Co-Fe-Si-B type, Fe-Si-B-C type, Fe-W-Ni-Mo type, Co-Zr type, Fe-Zr type, Ni-Zr type, etc. These materials may be used singly or by mixture. It is possible to impart the shape anisotropy to the above-mentioned alloys by, e.g., effecting a process of mechanically forming the alloys into those having a flat shape. The magnetic material may also comprise an iron-based metal oxide having a shape anisotropy and a maximum diameter of at most 2 μm. The iron-based metal oxide may be used singly or in mixture with the above-mentioned amorphous alloy. Examples of such an iron-based metal oxide may include those of magnetite ($FeO.Fe_2O_3$)-type, Ni type, Ni-Zn type, Mn-Zn type, Mn-Mg type, Li type, Li-Ni type, Li-Cu type, Cu-Zn type, Cu-Zn-Mg type, Mn-Mg-Al type, Co-Fe type, etc. In order to impart the shape anisotropy to the iron-based metal oxide, it is possible to effect various treatments, such as addition of several species of additives, control of liquid properties and concentration at the time of crystal growth, and temperature control or rapid cooling as heat treatment at the time of sintering or calcination.

In case of the magnetic material-dispersion type resinous carrier, it is possible to obtain the carrier of the present invention by mechanically or magnetically orienting magnetic fine particles by injection molding. The carrier of the present invention may also be prepared through polymerization under magnetic field application in case of a carrier prepared through polymerization. The carrier of the present invention may further be obtained by orienting carrier particles under magnetic field application at granulation of the carrier particles in case of a calcination-type carrier. At this time, it is important to keep the shape anisotropy and an amorphous state by sintering thus being required to effect heat treatment such as rapid cooling.

In the present invention, by taking such a composition and an orientation state, it is possible to provide a carrier having a magnetization ($\sigma_{1000}$) of 30–150 emu/cm$^3$ at 1000 (Oe) and a quickly increased magnetization at a low magnetic field.

In the magnetic material dispersion-type resinous carrier, the magnetic fine particles may be contained in a proportion of at least 30 wt. %, and, preferably, may be at least 50 wt. %. Below 30 wt. %, the carrier adhesion onto a photosensitive is liable to occur, and the resistivity control of the carrier also becomes difficult. In excess of 99 wt. % of the magnetic fine particles Content, the adhesion between the particles with the binder resin becomes inferior.

The binder resin used together with the magnetic material for constituting the dispersion-type carrier particles (which can also be used as core particles of a coated carrier) in the present invention may for example comprise the following materials.

Homopolymers or copolymers of vinyl monomers shown below: styrene; styrene derivatives, such as o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; ethylenically unsaturated monoolefins, such as ethylene, propylene, butylene and isoprene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate methacrylic acid; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acid; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; and acrolein. These may be used singly or in mixture of two or more species.

In addition to the vinyl-type resins (i.e., homopolymers or copolymers of vinyl monomers as described above), it is also possible to use non-vinyl or condensation-type resins, such as polyester resins, epoxy resins, phenolic resins, urea resins, polyurethane resins, polyimide resins, cellulosic resins and polyether resins, or mixtures of these resins with the above-mentioned vinyl-type resins.

A process for producing the magnetic material-dispersion type resinous carrier according to the present invention includes a step of preparing a (carrier) core material and optionally a step of coating the core material with a resin, as desired.

The core material may be prepared through a process wherein the binder resin and the magnetic fine particles are blended in a prescribed quantity ratio and kneaded at an appropriate temperature by a hot-melt kneading device, such as a three-roll kneader or an extruder, followed by orientation of the magnetic fine particles at the time of injection-molding, cooling, pulverization and classification. The thus-obtained core materials are caused to impinge at a high speed onto a plate for surface melting of the particles by impinging energy to improve their sphericity. As an alternative process, it is also possible to adopt a suspension polymerization process wherein the magnetic fine particles are mixed with a monomer liquid of the binder resin along with a polymerization initiator, a dispersion stabilizer, etc., and the mixture is dispersed within an aqueous medium, followed by suspension polymerization under application of a magnetic field.

The magnetic material dispersion-type resinous carrier particles can further be coated with a resin, as desired, for the purpose of, e.g., controlling the resistivity and improving the durability. The coating resin may be a known appropriate resin. Examples thereof may include acrylic resin, fluorine-containing resin, silicone resin, epoxy resin and styrene resin.

In case where the carrier particles (or the carrier core material) to be coated particularly comprise a large amount of a resin, it is preferred to use a rapid coating method wherein individual carrier particles do not adhere to each other. More specifically, it is preferred to appropriately select a solvent for the coating resin, adequately control the temperature and time for the coating, and keep the carrier particles (or the carrier core material) to be coated in an always fluidized state, so as to proceed with the coating and drying simultaneously.

The toner to be used in combination with the carrier according to the present invention may have a weight-average particle size of 1–20 μm, preferably 4–10 μm, as measured, e.g., by a Coulter counter, while the weight-average particle size may be measured in various ways.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected.

For measurement, a 1%-NaCl aqueous solution as an electrolyte solution is prepared by using a reagent-grade sodium chloride. Into 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a number-basis distribution. From the results of the number-basis distribution, the weight-average particle size of the toner may be obtained.

In order to obtain a high-quality image, the toner may preferably have as low an agglomeration degree as possible, particularly 30% or below. The agglomeration degree may be measured in the following manner.

Three sieves of 60 mesh, 100 mesh and 200 mesh are stacked in this order from the above and set on a powder tester (available from Hosokawa Micron K.K.), and a sample toner weighed in 5 g is placed on the sieves. Then, the sieves are vibrated for 30 sec. while applying a voltage of 170 volts, and the weights of portions of the toner sample remaining on the respective sieves are measured to calculate the agglomeration degree based on the following equation:

agglomeration degree=[((sample weight on 60 mesh-sieve)+(sample weight on 100 mesh-sieve)×3/5+(sample weight on 200 mesh-sieve)×1/5) / (sample weight (about 5 g) placed on the sieves)]×100

In order to lower the agglomeration degree, it is preferred to add a fluidity improver, such as silica, titanium oxide or alumina, to be internally incorporated within or externally mixed with the toner.

The carrier and the toner may preferably be mixed in such a ratio as to provide a two component-type developer having a toner concentration of 0.5–20 wt. %, particularly 1–10 wt. %.

Figure 4:
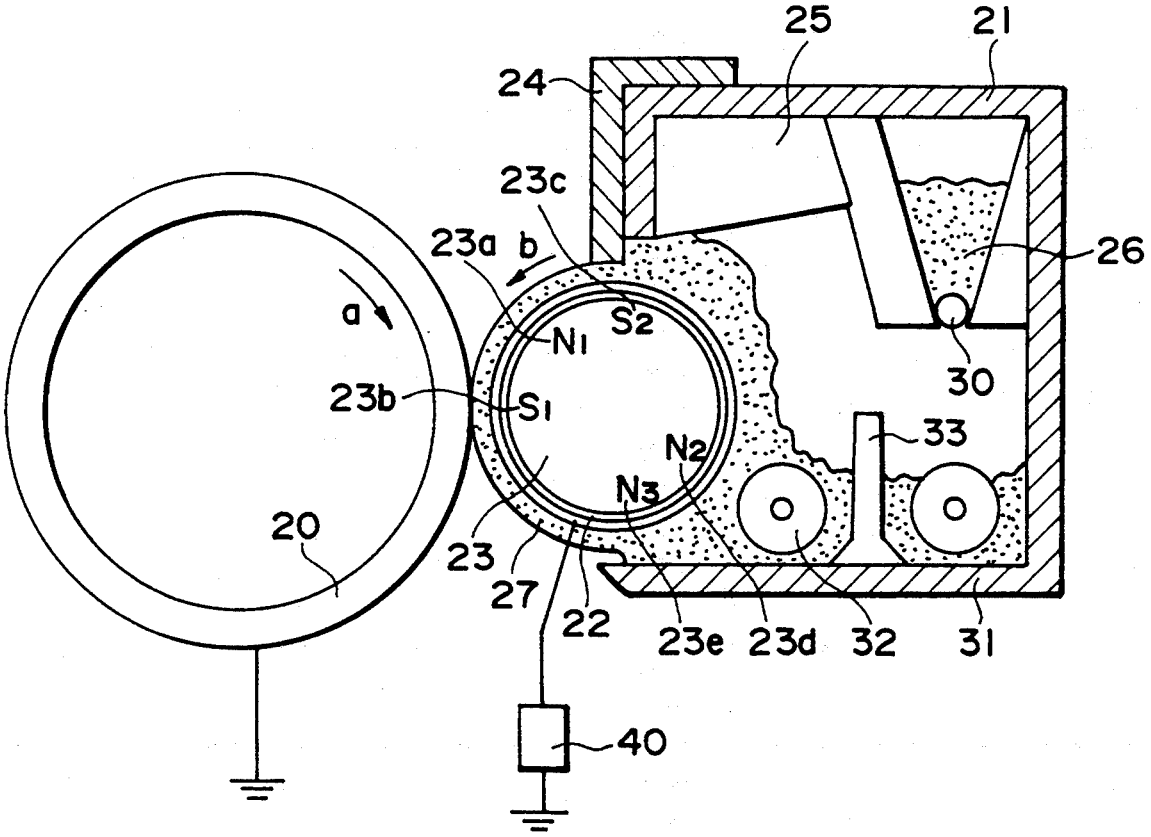
FIG. 4 is a schematic view of a developing device and a photosensitive drum used for the image forming method of the present invention.

Next, the image forming method according to the present invention will be described with reference to an embodiment using a developing apparatus shown in FIG. 4.

A latent image-bearing member 20 may be an insulating drum for electrostatic recording, or a photosensitive drum (as shown) or a photosensitive belt surfaced with a layer of an insulating photoconductor material, such as α-Se, CdS, $ZnO_2$, OPC (organic photoconductor) or a-Si. The latent image-bearing member 20 is rotated in the direction of an arrow a by a driving mechanism (not shown). In proximity with or in contact with the latent image-bearing member, a developing sleeve 22 (as a developer-carrying member) is disposed. The developing sleeve 22 is composed of a non-magnetic material, such as aluminum or SUS 316. About a right half of the developing sleeve 22 is projected into or enclosed within a lower-left part of a developer container 21 through a horizontally extending opening provided along the longitudinal extension of the container 21, and about a left-half of the developing sleeve 22 is exposed to outside the container. The developing sleeve 22 is rotatably held about an axis extending perpendicularly to the drawing and driven in rotation in the direction of an arrow b.

Within the developing sleeve 22 (developer-carrying member) is inserted a fixed permanent magnet 23 which is held in a position as shown as a fixed magnetic field generating means. The magnet 23 is fixedly held at a position as shown even when the developing sleeve 22 is driven in rotation. The magnet 23 has 5 magnetic poles including N-poles 23*a*, 23*d*, 23*e* and S-poles 23*b* and 23*c*. The magnet 23 can comprise an electro-magnet instead of a permanent magnet.

A non-magnetic blade 24 as a developer-regulating member, which has-been formed by bending a member of, e.g., SUS 316 so as to have an L-section as shown, is disposed at an upper periphery of the opening of the developer container 21 in which the developing sleeve 22 is installed so that the base part of the blade 24 is fixed to the wall of the container 21.

The magnetic carrier-regulating member 25 is disposed with its upper face directed toward the nonmagnetic blade 24 and with its lower face functioning as a developer guiding surface. A regulating part is constituted by the non-magnetic blade 24 and the magnetic carrier-regulating member 25.

A developer layer 27 is formed of a developer including the carrier of the present invention and a non-magnetic toner 27 supplied by a toner-replenishing roller 30 driven according to an output from a toner concentration-detecting sensor (not shown). The sensor may be constituted by a developer volume-detecting scheme, a piezoelectric device, induction change-detecting device, an antenna scheme utilizing an alternating bias, or an optical density-detecting scheme. The non-magnetic toner 26 is replenished in a controlled amount depending on the rotation and stopping of the roller 30. A fresh developer replenished with the toner 26 is mixed and stirred while being conveyed by a developer-conveying roller 31. As a result, during the conveyance, the replenished toner is triboelectrically charged. A partition 31 is provided with cuts at both longitudinal ends thereof, through which the fresh developer conveyed by the roller 31 is transferred to a screw 32.

An S-magnetic pole 23 is a conveying pole and functions to recover the unused developer into the container and convey the developer to the regulating part.

Near the S pole 23*d*, the fresh developer and the recovered developer are mixed with each other by the screw 32 disposed near the developing sleeve.

The lower end of the non-magnetic blade 24 and the surface of the developing sleeve 24 may be spaced from each other with a gap of 100–900 μm, preferably 50–800 μm. If the gap is smaller than 100 μ, the carrier particles are liable to clog the gap, thus being liable to cause an irregularity in the resultant developer layer and failing to apply the developer in a manner as to provide a good developing performance, thereby only resulting in developed images which are thin in image density and are accompanied by much irregularity. On the other hand, if the gap exceeds 900 μm, the amount of the developer applied onto the developing sleeve 22 is increased, thus failing in regulation to a prescribed developer layer thickness, resulting in an increased carrier adhesion onto the latent image-bearing member and weakening the regulation of the developer by the developer-regulating member 25 to cause an insufficient triboelectricity leading to a tendency to fog.

It is preferred that the developer layer thickness on the developing sleeve 22 is made equal to or slightly larger than a gap of preferably 50–800 μm, more preferably 100–700 μm, between the developing sleeve 22 and the latent image-bearing member 20 at their opposing position, while applying an alternating electric field across the gap.

By applying a developing bias comprising an alternating electric field optionally superposed with a DC electric field between the developing sleeve 22 and the latent image-bearing member 20, it is possible to facilitate the toner movement from the developing sleeve 22 to the latent image-bearing member 20, thereby forming images with further better qualities.

The alternating electric field may preferably comprise an AC electric field of 1000–10000 Vpp, more preferably 2000–8000 Vpp, optionally superposed with a DC electric field of at most 1000 V.

Hereinbelow, the present invention will be described based on Examples which should not be however understood to restrict the scope of the present invention. In the following description, "%" and "part(s)" used to describe a formulation mean those by weight unless otherwise noted specifically.

EXAMPLE 1

$Fe_2O_3$, $MnCO_3$, ZnO and $CaCO_3$ were weighed in proportion of 55 mol %, 31 mol %, 11 mol % and 3 mol %, respectively, blended and dried, followed by pulverization and calcination. The calcined material was pulverized in a ball mill to obtain magnetic fine particles having a particle size of at most 1 μm. The magnetic fine particles were formed into particles and then heated to 1000° C. at a rate of 100° C./hour, followed by calcination for 8 hours at 1000° C. to obtain calcined fine particles. The calcined fine particles were classified to obtain magnetic carrier core particles having an average particle size of 51 μm. The carrier core particles were almost spherical and had a smooth surface free from a particle boundary. The carrier core particles showed a bulk density of 2.72 g/cm$^3$ and a resistivity of $1.8\times10^7$ Ω.cm. The carrier core showed magnetic properties of $\sigma_{1000}=102$ emu/cm$^3$ $\sigma_r=3$ emu/cm$^3$, $\sigma_{300}=75$ emu/cm$^3$, $\sigma_{100}=36$ emu/cm$^3$, Hc=5 oersted, $(\sigma_{1000}-\sigma_{300})/\sigma_{1000}=0.26$ and $(r_{100}-\sigma_r)/100$ (oersted)=0.33 (emu/cm$^3$.oersted), thus satisfying the relationships (1) and (2).

The carrier (core) particles were then coated with about 0.7 wt. % of styrene/2-ethylhexyl methacrylate (copolymerization weight ratio: 50/50) copolymer by fluidized bed coating. The resin-coated carrier showed a resistivity of $6.1\times10^{12}$ Ω.cm and magnetic properties substantially identical to those of the carrier core.

A cyan toner was prepared from the following materials.

Polyester resin formed by condensation between propoxidized bisphenol and fumaric acid 100 wt.parts Copper phthalocyanine pigment 5"

Di-tert-butylsalicylic acid chromium complex salt 4"

The above materials were preliminarily blended sufficiently, melt-kneaded and, after cooling, coarsely crushed by a hammer mill into particles of about 1–2 μm, followed further by fine pulverization by an air jet pulverizer and classification to obtain a negatively chargeable cyan-colored powder (cyan toner) having a weight-average particle size of 8.4 μm.

100 wt. parts of the cyan toner were blended with 0.8 wt. part of silica fine powder treated with hexamethyldisilazane for hydrophobicity treatment to prepare a cyan toner carrying silica fine powder attached to the surface thereof (agglomeration degree =about 10%).

The above resin-coated carrier was blended with the cyan toner to obtain a two-component developer having a toner content of 5 wt. %. The developer was charged in a remodeled commercially available full-color laser copying machine ("CLC-500", mfd. by Canon K.K.) and used for image formation. FIG. 4 schematically illustrates the developing device and the photosensitive drum around the developing zone in the remodeled copying machine. The gap between the developing sleeve and the developer regulating member was 400 μm, the developing sleeve and the photosensitive member were rotated at a peripheral speed ratio of 1.4:1 with a peripheral speed of 300 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short, and the magnetic brush on the sleeve contacted the photosensitive drum at the developing station.

As a result of the image formation, supply of the developer on the developing sleeve was sufficient. The resultant images showed a sufficient density at a solid image part, were free from coarse images and showed particularly good reproducibility of halftone parts and line images. No toner adhesion due to, e.g., carrier scattering and/or development of the carrier was observed either at the image parts or the non-image parts despite a high-speed rotation of the developing sleeve. After 30 minutes of blank rotation of the developing sleeve at 200 rpm, image formation was again performed, whereby very good images were obtained with no problem at all regarding image qualities and no carrier adhesion.

COMPARATIVE EXAMPLE 1

$Fe_2O_3$, ZnO, CuO and $MnCO_3$ were weighed in proportions of 50 mol %, 20 mol %, 17 mol % and 13 mol %, respectively, and blended in a ball mill. From the blended material, carrier core particles having an average particle size of 52 μm were obtained in the same manner as in Example 1. The carrier core particles were almost spherical but a particle boundary was observed at the surface of the particles. The carrier core particles showed a bulk density of 2.17 g/cm$^3$ and a resistivity of $3.1\times10^9$ Ω.cm. The carrier core showed magnetic properties of $\sigma_{1000}=53$ emu/cm$^3$, $\sigma_r=2$ emu/cm$^3$, $\sigma_{300}=18$ emu/cm$^3$, $\sigma_{100}=7$ emu/cm$^3$, Hc=5 oersted, $(\sigma_{1000}-\sigma_{300})/\sigma_{1000}=0.66$, and $(\sigma_{100}-\sigma_r)/100=0.05$, thus failing to satisfy the relationships (1) and (2).

The thus-obtained carrier core was surface-coated with a resin in the same manner as in Example 1. The resin-coated carrier showed a resistivity of $1.5\times10^{12}$ ohm.cm and magnetic properties substantially identical to those of the carrier core. The resin-coated carrier was then blended with the same toner as in Example 1 in the same manner as in Example 1 to obtain a two-component developer.

The developer was used for image formation in the same manner as in Example 1. As a result, because of a small $\sigma_{1000}$ value, the magnetic brush on the developing sleeve was dense, and the result images showed halftone parts free from coarseness and very excellent reproducibility of thin lines, but carrier adhesion was observed at non-image parts because of a weak magnetization at 0–300 oersted, and correspondingly toner fog was observed at the non-image parts. After blank rotation in the same manner as in Example 1, coarseness was not observed at the halftone parts but carrier adhesion was caused.

COMPARATIVE EXAMPLE 2

$Fe_2O_3$, ZnO and CuO were weighed in molar proportions of 62 mol %, ZnO 16 mol % and 22 mol %, respectively, and blended in a ball mill. From the blended material, carrier particles having an average particle size of 50 μm were obtained in the same manner as in Example 1. These carrier particles were almost spherical and excellent in surface smoothness. The carrier core particles showed a bulk density of 2.77 g/cm$^3$ and a resistivity of $4.0\times10^9$ Ω.cm. The carrier core showed magnetic properties of $\sigma_{1000}=214$ emu/cm$^3$, $\sigma_r=2$ emu/cm$^3$, $\sigma_{300}=113$ emu/cm$^3$, $\sigma_{100}=40$ emu/cm$^3$, Hc=10 oersted $(\sigma_{1000}-\sigma_{300})/\sigma_{1000}=0.47$, and $(\sigma_{100}-\sigma_r)/100=0.38$, thus failing to satisfy the relationship (1) while satisfying the relationship (2).

The thus-obtained carrier was surface-coated with a resin in the same manner as in Example 1. The resin-coated carrier showed a resistivity of $3.2\times10^{12}$ ohm.cm and magnetic properties substantially identical to those of the carrier core. The resin-coated carrier was blended with the same toner in the same manner as in Example 1 to obtain a two-component developer.

The developer was used for image formation in the same manner as in Example 1, whereby the developer showed a good fluidity on the developing sleeve and good conveyability. However, the magnetic brush in the vicinity of the magnetic pole was observed to be sparse, thus resulting in coarseness at halftone parts. After blank rotation in the same manner as in Example 1, coarseness was observed particularly at the halftone parts.

EXAMPLE 2

$Fe_2O_3$, NiO and ZnO were weighed in proportions of 58 mol %, 15 mol % and 27 mol %, respectively, and blended in a ball mill, followed by calcination and pulverization.

After the pulverized particles were formed into particles and the resultant particles were calcined in the same manner as in Example 1 to obtain carrier core particles having an average particle size of 43 μm. The carrier core particles were almost spherical and a good surface smoothness. The carrier particles showed a bulk density of 2.64 g/cm$^3$ and a resistivity of $7.7\times10^8$ Ω.cm. The carrier core showed magnetic properties of $\sigma_{1000}=54$ emu/cm$^3$, $\sigma_r=1$ emu/cm$^3$, $\sigma_{300}=48$ emu/cm$^3$, $\sigma_{100}=32$ emu/cm$^3$, Hc=2 oersted, $(\sigma_{1000}-\sigma_{300})/\sigma_{1000}=0.11$, and $(\sigma_{100}-\sigma_r)/100=0.31$, thus satisfying the relationships (1) and (2).

The thus-obtained carrier core was surface-coated with a resin in the same manner as in Example 1. The resin-coated carrier showed a resistivity of $1.1\times10^{13}$ Ω.cm.

The resin-coated carrier was then blended with the same toner as in Example 1 in the same manner as in Example 1 to obtain a two-component developer having a toner content of 6 wt. %. The developer was used for image formation in the same manner as in Example 1. As a result, the magnetic brush on the developing sleeve was densel and good images were formed free from coarseness at halftone parts and with good reproducibility of thin line parts. Further, no carrier adhesion was observed. Images formed after the blank rotation was particularly excellent in uniform reproducibility of halftone parts and showed good reproducibility of thin line part. Further, there was no problem regarding carrier adhesion.

EXAMPLE 3

Fe, Ni, Cu and Cr were mixed in proportions of 17 mol %, 75 mol %, 6 mol % and 2 mol %, respectively, and the mixture in a molten state was atomized with water to obtain carrier core particles, which were then classified by a pneumatic classifier to obtain carrier particles having an average particle size of 45 μm. The carrier core particles were almost spherical and showed a bulk density of 2.90 g/cm$^3$ and a resistivity of $5.2\times10^{-3}$ ohm.cm. The carrier core showed magnetic properties of $\sigma_{1000}=132$ emu/cm$^2$, $\sigma_r=0$ emu/cm$^3$, $\sigma_{300}=110$ emu/cm$^3$, $\sigma_{100}=76$ emu/cm$^3$, Hc =0 oersted $(\sigma_{1000}-\sigma_{300})/\sigma_{1000}=0.17$, and $(\sigma_{100}-\sigma_r)/100=0.76$, thus satisfying the relationships (1) and (2).

The thus-obtained carrier carrier was surface coated with a resin in the same manner as in Example 1. The resin-coated carrier showed a resistivity of $9.2\times10^9$ ohm.cm and magnetic properties substantially identical to those of the carrier core.

The resin-coated carrier was then blended with the same toner as in Example 1 in the same manner as in Example 1 to obtain a two-component developer. The developer was used for image formation in the same manner as in Example 1. As a result, the resultant images showed a sufficient image density and uniformity at solid image parts, and good images were formed free from coarseness at halftone parts and with good reproducibility of thin line parts. Further, no carrier adhesion was observed at either the image part or the non-image part. Images formed after the blank rotation showed a good halftone part free from coarseness, a good image qualities and no carrier adhesion.

The resultant images showed a sufficient density at solid image parts, were free from coarseness and showed good reproducibility of halftone parts and particularly good reproducibility of line images. Further, no carrier adhesion was observed. Images formed after the blank rotation showed image qualities not inferior to those at the initial stage and did not encounter the problem of carrier adhesion.

The physical properties of the carriers prepared above are shown in Table 1 and the evaluation results thereof are shown in Table 2 wherein the respective marks indicate the following levels of performances:

◎: very good, ○: good,

Δ: fair, x: not acceptable.

TABLE 1

| Ex. No. | Size (μm) | Bulk density (g/cm³) | Magnetic material | Hc (öe) | $\sigma_{1000}$ (emu/cm³) | $\sigma_{300}$ (emu/cm³) | $\sigma_{100}$ (emu/cm³) | $\sigma_r$ (emu/cm³) | $\frac{\sigma_{1000}-\sigma_{300}}{\sigma_{1000}}$ | $\frac{\sigma_{100}-\sigma_r}{100}$ | Resistivity (Ω · cm) | Sphericity |
|---|---|---|---|---|---|---|---|---|---|---|---|---|
| Ex. 1 | 51 | 2.72 | Mn—Zn ferrite | 5 | 102 | 75 | 36 | 3 | 0.26 | 0.33 | $6.1\times10^{12}$ | 1.10 |
| Comp. Ex. 1 | 52 | 2.17 | Cu—Zn—Mn ferrite | 5 | 53 | 18 | 7 | 2 | 0.66 | 0.05 | $1.5\times10^{12}$ | 1.08 |
| Comp. Ex. 2 | 50 | 2.77 | Cu—Zn ferrite | 10 | 214 | 113 | 40 | 2 | 0.47 | 0.38 | $3.2\times10^{12}$ | 1.06 |
| Ex. 2 | 43 | 2.64 | Ni-Zn ferrite | 2 | 54 | 48 | 32 | 1 | 0.11 | 0.31 | $1.1\times10^{13}$ | 1.06 |
| Ex. 3 | 45 | 2.90 | Fe—Ni—Cu—Cr | 0 | 132 | 110 | 76 | 0 | 0.17 | 0.76 | $9.2\times10^{9}$ | 1.25 |

TABLE 2

| Example No. | Developer fluidity | Initial images: Solid part density | Solid part uniformity | Halftone reproducibility | Line reproducibility | Carrier adhesion | Images after 30 min. of blank rotation: Solid part density | Solid part uniformity | Halftone reproducibility | Line reproducibility | Carrier adhesion |
|---|---|---|---|---|---|---|---|---|---|---|---|
| Ex. 1 | ◎ | ◎ | ◎ | ◎ | ◎ | ◎ | ◎ | ◎ | ◎ | ◎ | ◎ |
| Comp. Ex. 1 | ◎ | ◎ | ◎ | ◎ | ◎ | x | ◎ | ◎ | ◎ | ◎ | x |
| Comp. Ex. 2 | ◎ | ◎ | ○ | ○ | ○ | ◎ | ◎ | x | x | Δ | ◎ |
| Ex. 2 | ◎ | ◎ | ◎ | ◎ | ◎ | ○ | ◎ | ◎ | ○ | ◎ | ○ |
| Ex. 3 | ◎ | ◎ | ◎ | ◎ | ◎ | ◎ | ◎ | ◎ | ○ | ○ | ◎ |
| Ex. 4 | ◎ | ◎ | ◎ | ◎ | ◎ | ◎ | ◎ | ◎ | ○ | ○ | ◎ |

EXAMPLE 4

A two-component developer was prepared by mixing the resin-coated carrier used in Example 2 and a toner prepared in the following manner.

| | |
|---|---|
| Styrene-acrylic resin | 100 wt. parts |
| Carbon black | 5 wt. parts |
| Di-tert-butylsalicylic acid chromium complex salt | 4 wt. parts |

From the above materials, a black toner having a weight-average particle size of 7.6 μm was prepared in the same manner as in Example 1.

100 wt. parts of the toner was blended with 0.7 wt. part of silica fine powder treated with hexamethyldisilazane for hydrophobicity treatment by a Henschel mixer to form a black toner carrying silica fine powder attached to the surface thereof.

The toner and the resin-coated carrier used in Example 2 were blended with each other to obtain a two-component developer having a toner concentration of 6%. The developer was used for image formation in the same manner as in Example 1.

EXAMPLE 5

| | |
|---|---|
| Styrene/methyl methacrylate (80/20) copolymer | 30 wt. parts |
| $Cu_{70}Fe_5Si_{10}B_{15}$ (flat-shaped) (maximum diameter = 1 μm, thickness = 0.07 μm) | 70 wt. parts |

The above materials were preliminarily blended sufficiently in a Henschel mixer, melt-knead two times by a three-roll mill and, after cooling, coarsely crushed by a hammer mill into chips with a particle size of about 5 mm. The chips were passed through an extruder heated to 200° C., injection-molded for orientation of the magnetic fine powder and then again subjected to cooling while applying a magnetic field of 10K oersted to the melted magnetic fine powder, and further crushing into a particle size of about 2 mm, followed further by fine pulverization by an air jet pulverizer into a particle size of about 50 μm. Then, the pulverized product was then mechanically sphericalized in a mechanomill ("MM-10", mfd. by Okada Seiko K.K.). The sphericalized particles were further classified to obtain magnetic material-dispersed resin particles (carrier core particles), which showed a particle size of 46 μm.

The core particles were then coated with a styrene-acrylic resin in the following manner.

A coating liquid for the core particles was prepared by dissolving 10 wt. % of the styrene-acrylic resin in a mixture solvent of acetone/methyl ethyl ketone (mixing ratio of 1/1 by weight). The core particles were coated with the coating liquid so as to provide a resin coating Mount of 1.0 wt. % by fluidized bed coating while proceeding with the coating and drying simultaneously. The thus coated core particles were dried for 2 hours at 90° C. to remove the solvent, whereby a resin-coated magnetic material dispersion-type resinous carrier (coated carrier) was obtained. The coated carrier showed a particle size substantially equal to that before the coating. As a result of sectional observation through an FE-SEM, the coated carrier showed a degree of orientation of the magnetic fine particles of 60%.

Figure 5:
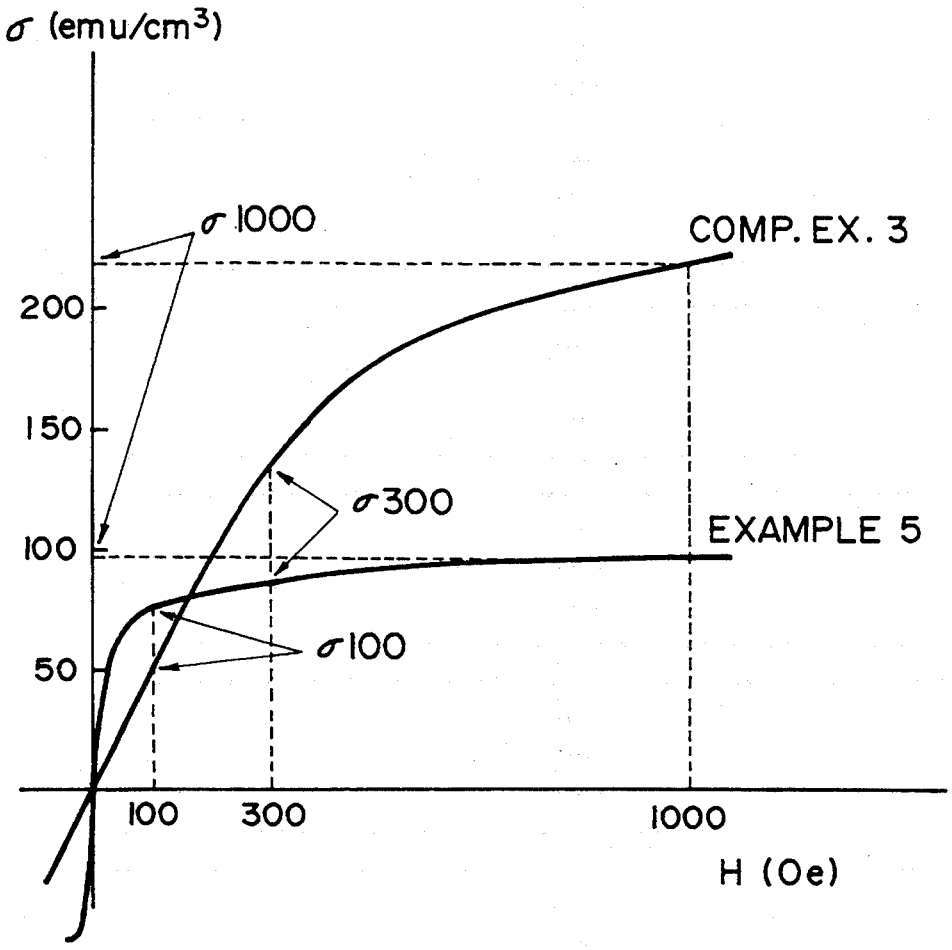
FIG. 5 is a graph showing magnetization curves of carriers.

The properties of the coated carrier are shown in Table 3 and FIG. 5 appearing hereinafter.

A cyan toner was prepared from the following materials.

| | |
|---|---|
| Polyester resin formed by condensation between propoxidized bisphenol and fumaric acid | 100 wt. parts |
| Copper Phthalocyanine pigment | 5 wt. parts |
| Di-tert-butylsalicylic acid chromium complex salt | 4 wt. parts |

The above materials were preliminarily blended sufficiently, melt-kneaded and, after cooling, coarsely crushed by a hammer mill into particles of about 1–2 μm, followed further by fine pulverization by an air jet pulverizer and classification to obtain a negatively chargeable cyan-colored powder (cyan toner) having a weight-average particle size of 8.4 μm.

100 wt. parts of the cyan toner was blended with 1.0 wt. part of silica fine powder treated with hexamethyldisilazane for hydrophobicity treatment to prepare a cyan toner carrying silica fine powder attached to the surface thereof (agglomeration degree =about 10%).

The above coated carrier was blended with the cyan toner to obtain a two-component developer having a toner content of 5 wt. %.

The developer was charged in a remodeled commercially available full-color laser copying machine ("CLC-500", mfd. by Canon K.K.) and used for image formation. FIG. 4 schematically illustrates the developing device and the photosensitive drum around the developing zone in the remodeled copying machine. The gap between the developing sleeve and the developer regulating member was 400 μm, the developing sleeve and the photosensitive member were rotated at a peripheral speed ratio of 1.4:1 with a peripheral speed (process speed) of 350 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short, and the magnetic brush on the sleeve contacted the photosensitive drum at the developing station.

As a result of the image formation, supply of the developer on the developing sleeve was sufficient. The resultant images showed a sufficient density (i.e., image density=1.52) at a solid image part, were free from coarse images and showed particularly good reproducibility of halftone parts and line images. No toner adhesion due to, e.g., carrier scattering and/or development of the carrier was observed either at the image parts or the non-image parts despite a high-speed rotation of the developing sleeve. After 30 minutes of blank rotation of the developing sleeve at 200 rpm, image formation was again performed, whereby very good images were obtained with no problem at all regarding image qualities and no carrier adhesion.

COMPARATIVE EXAMPLE 3

$Fe_2O_3$, ZnO and CuO were weighed in proportions of 62 mol %, 16 mol % and 22 mol %, respectively, and blended in a ball mill. The blended material was formed into particles and then calcined. The calcined particles were classified to obtain ferrite carrier core particles having an average particle size of 50 μm. The core particles were almost spherical and excellent in surface smoothness.

The core particles were surface-coated with the same resin in the same manner as in Example 5 to obtain a coated carrier (particles) having a particle size substantial equal to that before coating. The properties of the coated carrier are shown in Table 3 and FIG. 5.

The coated carrier was subjected to evaluation in the same manner as in Example 5. As a result, no carrier adhesion was caused. However, the ears of the developer on the developing sleeve were somewhat coarse and, while the initial images had no problem, images after the blank rotation particularly at halftone image parts were coarse.

EXAMPLE 6

| | |
|---|---|
| Phenol | 20 wt. parts |
| Formalin (formaldehyde = ca. 37%, methanol = ca. 10%, the remainder: water) | 10 wt. parts |
| $Co_{70}Fe_{4.95}Cr_{0.05}Si_{10}B_{15}$ (flat-shaped) (maximum diameter = 0.9 μm, thickness = 0.05 μm) | 70 wt. parts |

The above materials were stirred in an aqueous phase containing ammonia (basic catalyst) and calcium fluoride (polymerization stabilizer), gradually heated to 80° C. and subjected to 2 hours of polymerization while applying a magnetic field of 5,000 oersted with respect to a distance between magnetic poles (about 20 cm). After filtration and washing, the resultant polymerizate particles were classified to obtain magnetic material-dispersed resin particles (core particles).

The core particles were coated with the same resin in the same manner as in Example 5, whereby a good coating state was obtained. As a result of sectional observation through an FE-SEM, the coated carrier (particles) showed a degree of orientation of the magnetic fine particles of 62%. The properties of the coated carrier are shown in Table 3. The coated carrier was evaluated in the same manner as in Example 5, whereby good images were obtained at the initial stage and after blank rotation in the successive image forming test without causing carrier adhesion.

EXAMPLE 7

25 parts of styrene monomer, 10 parts of methyl methacrylate and 65 parts of flat-shaped $Co_{70.3}Fe_{4.7}Si_{10}B_{15}$ (maximum diameter=1.0 μm thickness=0.05 μm) were placed in a vessel, heated therein to 70° C. and held at 70° C. and azobisisobutyronitrile was added thereto to form a polymerizable mixture, which was then charged into a 2 liter-flask containing 1.2 liter of 1% PVA (polyvinyl alcohol) aqueous solution and stirred by a homogenizer at 2500 rpm for 10 min. in a magnetic field to form the mixture into the form of particles. Then, while being stirred by a paddle stirrer, the content was subjected to suspension polymerization for 10 hours under application of the magnetic field. After the polymerization, the product was cooled, filtered, washed, and dried to obtain magnetic material dispersed resinous carrier core particles.

The core particles were coated with the same resin in the same manner as in Example 5, whereby a good coating state was obtained. As a result of sectional observation through an FE-SEM, the coated carrier (particles) showed a degree of orientation of the magnetic fine particles of 51%. The properties of the coated carrier are shown in Table 3. The coated carrier was evaluated in the same manner as in Example 5, whereby the ears on the sleeve were dense and good images were obtained at the initial stage and after blank rotation in the successive image forming test without causing carrier adhesion.

EXAMPLE 8

A flat-shaped magnetic material ($Co_{70.3}Fe_{4.7}Si_{10}B_{15}$; maximum diameter = 1.0 μm, thickness 0.05 μm) was dispersed within 3% PVA aqueous solution under application of a magnetic field to obtain a slurry. The slurry was formed into particles having a particle size of about 50 μm by a spray drier, followed by reaction (calcination) for 2 hours at 1000° C. and rapid cooling to obtain carrier core particles having a particle size of 47 μm.

The core particles were coated with the same resin in the same manner as in Example 5. The properties of the coated carrier are shown in Table 3.

The coated carrier was evaluated in the same manner as in Example 5, whereby good images were obtained with no carrier adhesion both in the initial stage and after the successive image forming test. Images formed after the blank rotation showed a good halftone part free from coarseness, a good image quality and no carrier adhesion.

EXAMPLE 9

| | |
|---|---|
| Styrene-butyl methacrylate (80/20) copolymer | 35 wt. parts |
| Hexagonal plate-like magnetite | 65 wt. parts |

Magnetic material-dispersed resin particles (carrier core particles) having an average particle size of 40 μm were obtained in the same manner as in Example 5 except for using the above materials.

The core particles were coated with the same resin in the same manner as in Example 5. The properties of the coated carrier are shown in Table 3.

The coated carrier was evaluated in the same manner as in Example 5, whereby good image qualities were obtained with no carrier adhesion both in the initial stage and after the blank rotation.

The physical properties of the carriers prepared above are shown in Table 3 and the evaluation results thereof are shown in Table 4 wherein the respective marks indicate the following levels of performances:

◎: very good, ○: good,

Δ: fair, x: not acceptable.

TABLE 3

| Ex. No. | Size (μm) | Bulk density (g/cm³) | Magnetic material | Hc (Oe) | $\sigma_{1000}$ (emu/cm³) | $\sigma_{300}$ (emu/cm³) | $\sigma_{100}$ (emu/cm³) | $94_r$ (emu/cm³) | $\frac{\sigma_{1000}-\sigma_{300}}{\sigma_{1000}}$ | $\frac{\sigma_{100}-\sigma_r}{100}$ | Orientation (%) | Resistivity (Ω · cm) | Sphericity |
|---|---|---|---|---|---|---|---|---|---|---|---|---|---|
| Ex. 5 | 46 | 1.88 | Co—Fe—Si—B | 2 | 98 | 88 | 75 | 1 | 0.10 | 0.74 | 60 | $4.2 \times 10^{12}$ | 1.16 |
| Comp. | 50 | 2.47 | Cu—Zn ferrite | 2 | 216 | 134 | 50 | 2 | 0.62 | 0.48 | — | $1.2 \times 10^{13}$ | 1.06 |
| Ex. 6 | 44 | 1.93 | Co—Fe—Cr—Si—B | 3 | 85 | 77 | 68 | 2 | 0.09 | 0.66 | 62 | $3.5 \times 10^{12}$ | 1.04 |
| Ex. 7 | 43 | 1.61 | Co—Fe—Si—B | 1 | 75 | 63 | 49 | 1 | 0.16 | 0.48 | 51 | $2.3 \times 10^{13}$ | 1.07 |
| Ex. 8 | 47 | 2.63 | Co—Fe—Si—B | 1 | 141 | 123 | 104 | 0.3 | 0.13 | 1.04 | 51 | $4.2 \times 10^{10}$ | 1.12 |
| Ex. 9 | 40 | 1.58 | Hexagonal plate-like magnetite | 42 | 92 | 82 | 73 | 9.7 | 0.11 | 0.83 | 58 | $7.5 \times 10^{12}$ | 1.18 |

TABLE 4

| Example No. | Developer fluidity | Initial images: Solid part density | Solid part uniformity | Halftone reproducibility | Line reproducibility | Carrier adhesion | Images after 30 min. of blank rotation: Solid part density | Solid part uniformity | Halftone reproducibility | Line reproducibility | Carrier adhesion |
|---|---|---|---|---|---|---|---|---|---|---|---|
| Ex. 5 | ◎ | 1.52 | ◎ | ◎ | ◎ | ◎ | 1.50 | ◎ | ◎ | ◎ | ◎ |
| Comp. Ex. 3 | ◎ | 1.47 | ○ | ○ | ○ | ◎ | 1.44 | x | x | Δ | ◎ |
| Ex. 6 | ◎ | 1.48 | ◎ | ◎ | ◎ | ◎ | 1.48 | ◎ | ◎ | ◎ | ◎ |
| Ex. 7 | ◎ | 1.45 | ◎ | ◎ | ◎ | ○ | 1.45 | ◎ | ◎ | ◎ | ○ |
| Ex. 8 | ◎ | 1.58 | ◎ | ◎ | ◎ | ◎ | 1.54 | ○ | ○ | ○ | ◎ |
| Ex. 9 | ◎ | 1.56 | ◎ | ◎ | ◎ | ◎ | 1.55 | ◎ | ◎ | ◎ | ◎ |

◎: Excellent, ○: Good, Δ: Fair, x: Poor

What is claimed is:

1. A carrier for use in electrophotography, comprising carrier particles having an average particle size of 5–100 μm, wherein said carrier comprises a soft magnetic material having a bulk density of at most 3.0 g/cm³, and magnetic properties including: a magnetization of 30–150 emu/cm³ under a magnetic field strength of 1000 oersted, a coercive force Hc of at most 42 oersted and relationships (1) and (2):

$$|\sigma_{1000}-\sigma_{300}|/\sigma_{1000} \leqq 0.40 \quad (1)$$

wherein $\sigma_{1000}$ and $\sigma_{300}$ denote magnetizations (emu/cm$^3$) under magnetic field strengths of 100 oersted (Oe) and 300 oersted (Oe); respectively, and $$0.15\ (\text{emu/cm}^3.\text{Oe}) \leqq |\sigma_{100}-\sigma_r|/100\ (\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

2. The carrier according to claim 1, wherein said carrier particles comprise a ferrite containing: Fe and O as essential elements; at least one species of a third element selected from the group consisting of Li, Be, B, C, N, Na, Mg, Al, Si, P, S, K, Ca, Ti, V, Cr, Mn, Co, Ni, Cu, Zn, Ga, Ge, As, Se Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb and Bi, and less than 1 wt. %, if any, of a fourth element different from Fe, O and the third element based on the ferrite.

3. The carrier according to claim 1, wherein said carrier particles comprise a ferrite having a single phase of a spinel structure.

4. The carrier according to claim 1, wherein said carrier particles have a resistivity of $10^8$–$10^{13}$ ohm.cm.

5. The carrier according to claim 1, wherein said carrier particles are coated with a resin.

6. The carrier according to claim 1, wherein said carrier particles have a magnetization of 30–120 emu/cm$^3$ under a magnetic field strength of 1000 oersted.

7. The carrier according to claim 1, wherein said carrier particles have a value of $|\sigma_{1000}-\sigma_{300}|/\sigma_{1000}$ is at most 0.30.

8. The carrier according to claim 1, wherein said carrier particles have an average particle size of 20–60 μm.

9. The carrier according to claim 1, wherein said carrier particles have a sphericity of at most 2.

10. The carrier according to claim 1, wherein said carrier particles comprise magnetic fine particles made of a soft magnetic material, at least 30 wt. % of the magnetic fine particles being oriented, the magnetic fine particles showing a shape anisotropy in three-dimensions of at least a uniaxial direction and having a ratio of longer axis/shorter axis of more than 1.

11. The carrier according to claim 10, wherein said magnetic fine particles are dispersed within a binder resin in an amount of 30–99 wt. %.

12. The carrier according to claim 10, wherein said magnetic fine particles are dispersed within a binder resin in an amount of 50–99 wt. %.

13. The carrier according to claim 10, wherein said carrier particles are coated with a resin.

14. A two component-type developer for developing an electrostatic image, comprising a toner and a carrier, said carrier comprising carrier particles having an average particle size of 5–100 μm, wherein said carrier comprises a soft magnetic material having a bulk density of at most 3.0 g/cm$^3$, and magnetic properties including: a magnetization of 30–150 emu/cm$^3$ under a magnetic field strength of 1000 oersted, a coercive force Hc of at most 42 oersted and relationships (1) and (2):

$$"\sigma_{1000}-\sigma_{300}|/\sigma_{1000} \leqq 0.40 \quad (1)$$

wherein $\sigma_{1000}$ and $\sigma_{300}$ denote magnetizations (emu/cm$^3$) under magnetic field strengths of 1000 oersted (Oe) and 300 oersted (Oe), respectively, and $$0.15\ (\text{emu/cm}^3.\text{Oe}) \leqq |\sigma_{100}{}^{31}\ \sigma_r|/100(\text{Oe}) \quad (2)$$

wherein $\sigma_{100}$ and $\sigma_r$ denote magnetizations (emu/cm$^3$) under magnetic field strengths of 100 (Oe) and zero (Oe), respectively.

15. The developer according to claim 14, wherein said toner is contained at 0.5–20 wt. % based on the developer.

16. The developer according to claim 14, wherein said toner is contained at 1–10 wt. % based on the developer.

17. The developer according to claim 14, wherein said toner has an agglomeration degree of at most 30%.

18. The developer according to claim 14, wherein said toner has a weight-average particle size of 1–20 μm

19. The developer according to claim 14, wherein said toner has a weight-average particle size of 4–10 μm.

20. The developer according to claim 14, wherein said carrier particles comprise a ferrite containing: Fe and O as essential elements; at least one species of a third element selected from the group consisting of Li, Be, B, C, N, Na, Mg, Al, Si, P, S, K, Ca, Ti, V, Cr, Mn, Co, Ni, Cu, Zn, Ga, Ge, As, Se, Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb and Bi, and less than 1 wt. %, if any, of a fourth element different from Fe, O and the third element based on the ferrite.

21. The developer according to claim 14, wherein said carrier particles comprise a ferrite having a single phase of a spinel structure.

22. The developer according to claim 14, wherein said carrier particles have a resistivity of $10^8$–$10^{13}$ ohm.cm.

23. The developer according to claim 14, wherein said carrier particles are coated with a resin.

24. The developer according to claim 14, wherein said carrier particles have a magnetization of 30–120 emu/cm$^3$ under a magnetic field strength of 1000 oersted.

25. The developer according to claim 14, wherein said carrier particles have a value of $|\sigma_{1000}-\sigma_{300}|/\sigma_{1000}$ is at most 0.30.

26. The developer according to claim 14, wherein said carrier particles have an average particle size of 20–60 μm.

27. The developer according to claim 14, wherein said carrier particles have a sphericity of at most 2.

28. The developer according to claim 14, wherein said carrier particles comprise magnetic fine particles made of a soft magnetic material, at least 30 wt. % of the magnetic fine particles being oriented, the magnetic fine particles showing a shape anisotropy in three-dimensions of at least a uniaxial direction and having a ratio of longer axis/shorter axis of more than 1.

29. The developer according to claim 28, wherein said magnetic fine particles are dispersed within a binder resin in an amount of 30–99 wt. %.

30. The developer according to claim 28, wherein said magnetic fine particles are dispersed within a binder resin in an amount of 50–99 wt. %.

31. The developer according to claim 28, wherein said carrier particles are coated with a resin.

32. The carrier according to claim 1, wherein said soft magnetic material has a coercive force Hc of at most 5 oersted.

33. The carrier according to claim 1, wherein said soft magnetic material has a residual magnetization $\sigma r$ of at most 9.7 emu/cm$^3$.

34. The carrier according to claim 38, wherein said soft magnetic material has a residual magnetization $\sigma r$ of at most 3 emu/cm$^3$.

35. The carrier according to claim 1, wherein said soft magnetic material has a coercive force Hc of at most 5 oersted and a residual magnetization $\sigma r$ of at most 3 emu/cm$^3$.

36. The developer according to claim 14, wherein said soft magnetic material has a coercive force Hc of at most 5 oersted.

37. The developer according to claim 14, wherein said soft magnetic material has a residual magnetization $\sigma r$ of at most 9.7 emu/cm$^3$.

38. The developer according to claim 37, wherein said soft magnetic material has a residual magnetization $\sigma r$ of at most 3 emu/cm$^3$.

39. The developer according to claim 14, wherein said soft magnetic material has a coercive force Hc of at most 5 oersted and a residual magnetization $\sigma r$ of at most 3 emu/cm$^3$.

* * * * *

UNITED STATES PATENT AND TRADEMARK OFFICE

CERTIFICATE OF CORRECTION

PATENT NO. : 5,439,771

DATED : August 8, 1995

INVENTOR(S) : YOSHINOBU BABA, ET AL.

It is certified that error appears in the above-indentified patent and that said Letters Patent is hereby corrected as shown below:

COLUMN 1

Line 23, "image" should read --image.--.

COLUMN 2

Line 42, "for!" should read --for--.

COLUMN 3

Line 8, "Capable" should read --capable--; and

Line 19, "$|\sigma_{1000}-\sigma_{300}|\sigma_{1000}\leq 0.40$ (1)" should read --$|\sigma_{1000}-\sigma_{300}|/\sigma_{1000}\leq 0.40$ (1)--.

COLUMN 7

Line 14, "X$\sigma$/4 should read -- x$\pi$/4, --.

Line 64, "bed B, should read --Be,B --.

COLUMN 10

Line 3, "sintering" should read --sintering,--; and

Line 17, "Content," should read --content,--.

COLUMN 13

Line 29, "50-800" should read --150-800--; and

Line 30, "100$\mu$." should read --100$\mu$m,--.

UNITED STATES PATENT AND TRADEMARK OFFICE

CERTIFICATE OF CORRECTION

PATENT NO. : 5,439,771

DATED : August 8, 1995

INVENTOR(S) : YOSHINOBU BABA, ET AL.

It is certified that error appears in the above-indentified patent and that said Letters Patent is hereby corrected as shown below:

COLUMN 14

Line 4, "proportion" should read --proportions--; and

Line 19, "emu/cm$^3$" should read --emu/cm$^3$,--.

COLUMN 16

Line 45, "densel" should read --dense,--.

COLUMN 19

Line 5, "Mount" should read -- amount --.

COLUMN 22

Table 3, "94$_\gamma$" should read -$\sigma r$-.

COLUMN 23

Line 15, "Se Rb," should read --Se, Rb,--; and

Line 64, "$\sigma_{1000}-\sigma_{300}|/\sigma_{1000}\leq 0.40$ (1)" should read --$\sigma_{1000}-\sigma_{300}|\sigma_{1000}\leq 0.40$ (1)--.

UNITED STATES PATENT AND TRADEMARK OFFICE

CERTIFICATE OF CORRECTION

PATENT NO. : 5,439,771

DATED : August 8, 1995

INVENTOR(S) : YOSHINOBU BABA, ET AL.

It is certified that error appears in the above-indentified patent and that said Letters Patent is hereby corrected as shown below:

COLUMN 24

Line 2, "$_{0.15(emu/cm3Oe)} \leq |\sigma_{100}{}^{31}\ \sigma_{\gamma}|/100(Oe)$ (2)" should read --$_{0.15(emu/cm3 \cdot Oe)} \leq |\sigma_{100}{}^{31}\ \sigma_{\gamma}|/100(Oe)$ (2)--; and Line 16, "1-20 μm" should read --1-20 μm.--.

COLUMN 25

Line 5, "claim 38," should read --claim 33,--.

Signed and Sealed this

Fifth Day of March, 1996

Bruce Lehman

*Attest:*

BRUCE LEHMAN

*Attesting Officer*

*Commissioner of Patents and Trademarks*